US005555717A

United States Patent [19]

Schuller et al.

[11] Patent Number: 5,555,717

[45] Date of Patent: Sep. 17, 1996

[54] OPEN-END SPINNING DEVICE HAVING AN IMPROVED FIBER FEEDING CHANNEL

[75] Inventors: Edmund Schuller, Ingolstadt; Eva-Maria Greppmeier, Gachenbach; Anton Furtmeier, Neustadt/Donau, all of Germany

[73] Assignee: Rieter Ingolstadt Spinnereimaschinenbau AG, Ingolstadt, Germany

[21] Appl. No.: 435,111

[22] Filed: May 1, 1995

[30] Foreign Application Priority Data

May 13, 1994 [DE] Germany ..... 44 16 977.9

[51] Int. Cl.[6] ..... D01H 4/00; D01B 1/00

[52] U.S. Cl. ..... 57/413; 19/97; 57/406; 57/407; 57/408; 57/411

[58] Field of Search ..... 57/406, 407, 408, 57/410, 411, 412, 413; 19/112, 97

[56] References Cited

U.S. PATENT DOCUMENTS

| | | | |
|---|---|---|---|
| 4,069,686 | 6/1978 | Stahlecker et al. | 57/406 |
| 4,098,065 | 7/1978 | Stahlecker et al. | 57/408 |
| 4,387,558 | 6/1983 | Rehm et al. | 57/408 |
| 4,461,141 | 7/1984 | Hofmann et al. | 57/408 |
| 4,505,102 | 3/1985 | Landwehrkamp et al. | 57/413 |
| 4,653,266 | 3/1987 | Oexler et al. | 57/406 |
| 4,704,860 | 11/1987 | Stahlecker | 57/408 |
| 5,111,651 | 5/1992 | Pohn et al. | 57/413 |
| 5,117,622 | 6/1992 | Stahlecker | 57/407 |
| 5,398,494 | 3/1995 | Wassenhoven et al. | 57/406 |

FOREIGN PATENT DOCUMENTS

| | | | |
|---|---|---|---|
| 3205303 | 9/1982 | Germany . | |
| 291711 | 11/1988 | Japan | 57/408 |
| 2164671 | 3/1986 | United Kingdom | 19/112 |

*Primary Examiner*—William Stryjewski
*Attorney, Agent, or Firm*—Dority & Manning

[57] ABSTRACT

In the recess of a housing (4) of an open-end spinning device containing a driven opener roller (40), an insertion piece (32) is provided which contains the first channel part (30) of a fiber feeding channel. The insertion piece (32) is installed in housing (4) by an elastic retaining element in such a manner as to be replaceable. The retaining element may be part of a catch and be formed for this purpose by a ring or pot-like insert (43) which lines the interior of the housing (4) containing the opener roller (40) and which has technologically necessary openings (430, 432, 431) in its circumferential wall. The edges of the lateral walls of the first channel part (30) towards the ring or pot-shaped insert are adapted to the curvature of the insert (43). These lateral walls extend, relative to a perpendicular dropped from the center of the insert (43) on the longitudinal axis of the insertion piece (32), up to the side of the perpendicular (323) away from the spinning element (10).

16 Claims, 4 Drawing Sheets

OPEN-END SPINNING DEVICE HAVING AN IMPROVED FIBER FEEDING CHANNEL

BACKGROUND OF THE INVENTION

The instant invention relates to an open-end spinning element with a housing in the interior of which a driven opener roller is installed, as well as with a fiber feeding channel extending from the housing to the spinning element. The fiber feeding channel consisting of two channel parts of which the first channel part consists of an insert piece located in a recess of the housing and the second channel part is movable relative to the first channel part and can be aligned flush with the same.

Such a design is generally known, e.g. through the rotor spinning machine model RU11 of Schubert & Salzer Maschinenfabrik Aktiengesellschaft. The insert piece which receives the first channel part is here glued into a recess of the opener roller housing. In this manner, this channel part always assumed an optimal position relative to the opener roller housing in which becoming caught between housing and channel part is safely avoided. As a rule the entire opener roller housing is replaced in case of wear, since it is extremely difficult, and possible only after removing the housing from the spinning station by means of special devices and tools, to loosen the channel part by heating it so that the glue may become loose. Cleaning of the housing recess in which a new channel part is to be inserted is then necessary. And finally the danger exists that when a new channel part is inserted, glue enters the area through which the fibers pass later on in the spinning process. In a spinning plant the necessary shop conditions for this do not normally exist, so that a replacement of the channel part by the customer is, as a rule, out of the question, practically rendering moot the question of replaceability.

OBJECTS AND SUMMARY OF THE INVENTION

It is therefore a principal object of the instant invention to further develop a device of the type mentioned initially so that optimal seating of the channel part relative to the opener roller housing is ensured on the one hand, but also so that on the other hand the insertion may be carried out easily when necessary, also without removing the opener roller housing from the spinning machine. Additional objects and advantages of the invention will be set forth in part in the following description, or may be obvious from the description, or may be learned through practice of the invention.

The objects are attained by the invention in that the insertion piece is installed so that it can be replaced in the housing by means of an elastic retention piece. The replaceability of the channel part makes it possible for the channel part to be replaced by a new channel part in case of wear. In addition, this replaceability also opens the possibility of using a channel part of a different dimension and to achieve adaptation to different fiber materials.

An embodiment of the device according to the invention in which the elastic retention element is placed in such a manner relative to the insertion piece that it acts upon said insertion piece essentially radially outward with reference to the opener roller is especially advantageous. In this manner, the insertion piece in its operating position presses against its longest wall, and this ensures secure orientation of the insertion piece and excludes jamming of same.

The insertion piece used should assume a defined position in such a manner with respect to the fiber-carrying parts of the housing that no gaps or slits are formed in which fibers may become caught. For this reason, the insertion piece is advantageously provided with a stop which interacts with a stop of the housing which limits its movement in the direction of the housing. In principle the two interacting stops may be provided at any desired location.

In principle, the retaining element may be made in different manners. An especially advantageous embodiment of the invention can be achieved if the retaining element consists of a ring or pot-shaped insert which lines the interior of the housing receiving the opener roller and is provided with the technologically required opening in its circumference.

In lining the opener roller housing by means of such a ring or pot, the stop of the housing is advantageously formed by the outer circumferential wall of the insert and the stop of the insertion piece has a configuration which is adapted to the curvature of the outer circumferential wall of the insert. Since the stops are at the location where this is of crucial importance, i.e. between ring or pot-shaped insert and insertion piece, catching of fibers at this point is safely avoided.

In an advantageous further development of the invention, the retaining element is made as part of a clamping apparatus.

In principle, the clamping apparatus constituting the retaining device for the insertion piece may be of different design; e.g. two clamping jaws acting elastically upon the insertion piece may be provided at two sides of the recess receiving the insertion so as to face each other. In that case, the clamping device can also be made so as to be controllable. In an especially simple but nevertheless effective and therefore preferred embodiment of the invention, the clamping device is constituted by this insert and the facing inner wall of the recess receiving the insertion piece if a ring or pot-shaped insertion is provided for the housing.

The insert may consist of a ring or a pot in this case, as mentioned earlier, which is inserted into the housing so as to be replaceable. If a rigid insert is used, e.g. a steel ring, a movable clamping element subjected to the force of a spring or similar elastic device may be installed in the wall of the recess across from the insert. This elastically stressed element mounted in the wall of the recess can, however, be omitted if the insert is made of an elastic material according to another advantageous embodiment of the invention.

In a preferred further development of the device according to the invention, the retaining element is part of a catch. A catch has the advantage that it secures the insertion piece not only in its current position against any axial movements, but in that it furthermore ensures that the insertion piece assumes a defined position which is determined by the catch position.

The catch can also be made in different manners. Preferably the catch is provided with an elastic element which acts upon the insertion piece with a force component in the direction of the stop of the housing so that this stop and the elastic catch element together constitute the catch. The elastic catch element thus not only ensures retention of the channel part, but ensures that the insertion piece reaches its optimal work position and remains therein.

An especially advantageous embodiment of the instant invention which is in addition also simple in its construction is achieved when the retaining element is constituted by the ring or pot-shaped insert in that the edges of the lateral walls of the first channel part facing this ring or pot-shaped insert are adapted to the curvature of the insert, whereby these lateral walls, relative to the perpendicular falling from the center of the insert on the longitudinal axis of the insertion piece, extend up to the side of the perpendicular away from the spinning element. Since the insertion piece must be capable of being shifted in an axial direction, it has a circumferential surface serving as a guiding surface which remains unchanged over the length of the insertion piece. The longitudinal axis corresponds therefore to the direction of axial movement of the insertion piece, whatever its cross-sectional form may be.

To make it possible for the insertion piece to be removed easily from the housing without having to act from the inside of the housing upon the insertion piece, an advantageous further development of the instant invention provides for the insertion piece to extend as far as the outside of the housing and to be provided with a collar in its area outside the housing. In order to further facilitate the disassembly of the insertion piece the collar and/or the outer surface of the housing across from this collar is advantageously provided with a radial recess, accessible from the outside, for momentary acceptance of a disassembly tool for the insertion piece.

In its classical construction, an opener roller housing is provided with an extension on its face constituting the bottom in order to accept a bearing for the opener roller installed in the opener roller housing, whereby this bearing sticks out in an axial direction and thus renders access to the actual housing more difficult. On the housing bottom, with its face across from the bearing however, the housing is covered by a removable cover which is only very thin and does not therefore interfere with the accessibility of the housing in any manner. For this reason, an advantageous embodiment of the invention provides for the recess for the momentary reception of a disassembly tool to be provided on the side of the housing away from the bearing of the opener roller.

A purpose of the invention is to safely exclude the possibility of fibers to become caught on the fiber guiding surfaces of the fiber feeding channel. For this reason it is important for the transition surfaces to be made with utmost precision. This can be done most easily in that the insertion piece is given a form in its area towards the interior of the opener roller housing that is precisely adapted to the form of the interior space. This is especially true in the transition area going from the fiber-conveying surface of the opener roller housing before the insertion piece to the insertion piece as well as in the transition area going from the insertion piece to the inner circumferential surface of the opener roller housing after the insertion piece by machining the surface of the insertion piece towards the interior of the housing while this insertion piece is inserted into the recess in the opening roller housing. To ensure that this insertion piece will then maintain its rotational position in the recess, the housing is provided a guide for the collar of the insertion piece on its side towards the spinning element in an advantageous embodiment of the invention, said collar having an outer contour constituting an anti-rotational security together with this guide.

When the finished insertion piece assumes its working position, static coincidence must be avoided, since the tension forces produced by this take affect at the points of least resistance. When an elastic ring or pot-shaped insert is used, it is this insert. Otherwise an oblique jamming of the insert in the recess may result. This may lead to gaps between the opener roller housing or its ring or pot-shaped insert, resulting in a jamming and retention of fibers which are then loosened in form of fiber clots at any unforeseeable point in time and enter the spinning device where they interfere with the spinning process or at least in the spun yarn. In order to avoid this, a predetermined clearance is provided in an another advantageous further development of the device (if the latter is provided with an anti-rotation device interacting with the collar of the insertion piece) between the outer contour of the collar of the insertion piece accepting the first channel part of the insertion piece and the guide.

The second channel part is movable relative to the first channel part. In order to ensure optimal fiber guidance in the operating position of the second channel part, another advantageous embodiment of the invention provides for the guide of the collar of the insertion piece in operating position to project in the direction of the spinning element and is at the same time made in the form of a guide for the movable second channel part.

The invention is simple in its construction and makes it possible to reliably avoid fibers becoming caught in the transition area going from the opener roller housing to the fiber feeding channel. In addition, the possibility is created to react to changed fiber material in a quick and simple manner by replacing the insertion piece in the opener roller housing. The invention also creates the condition making it possible to quickly remove an insertion piece which has become unusable from the housing in case of wear, without having to remove the housing, and to replace it by inserting a new insertion piece into the recess of the housing. Examples of embodiments of the device according to the invention are described hereinafter with the help of drawings.

DETAILED DESCRIPTION OF THE PREFERRED EMBODIMENTS

Figure 1:
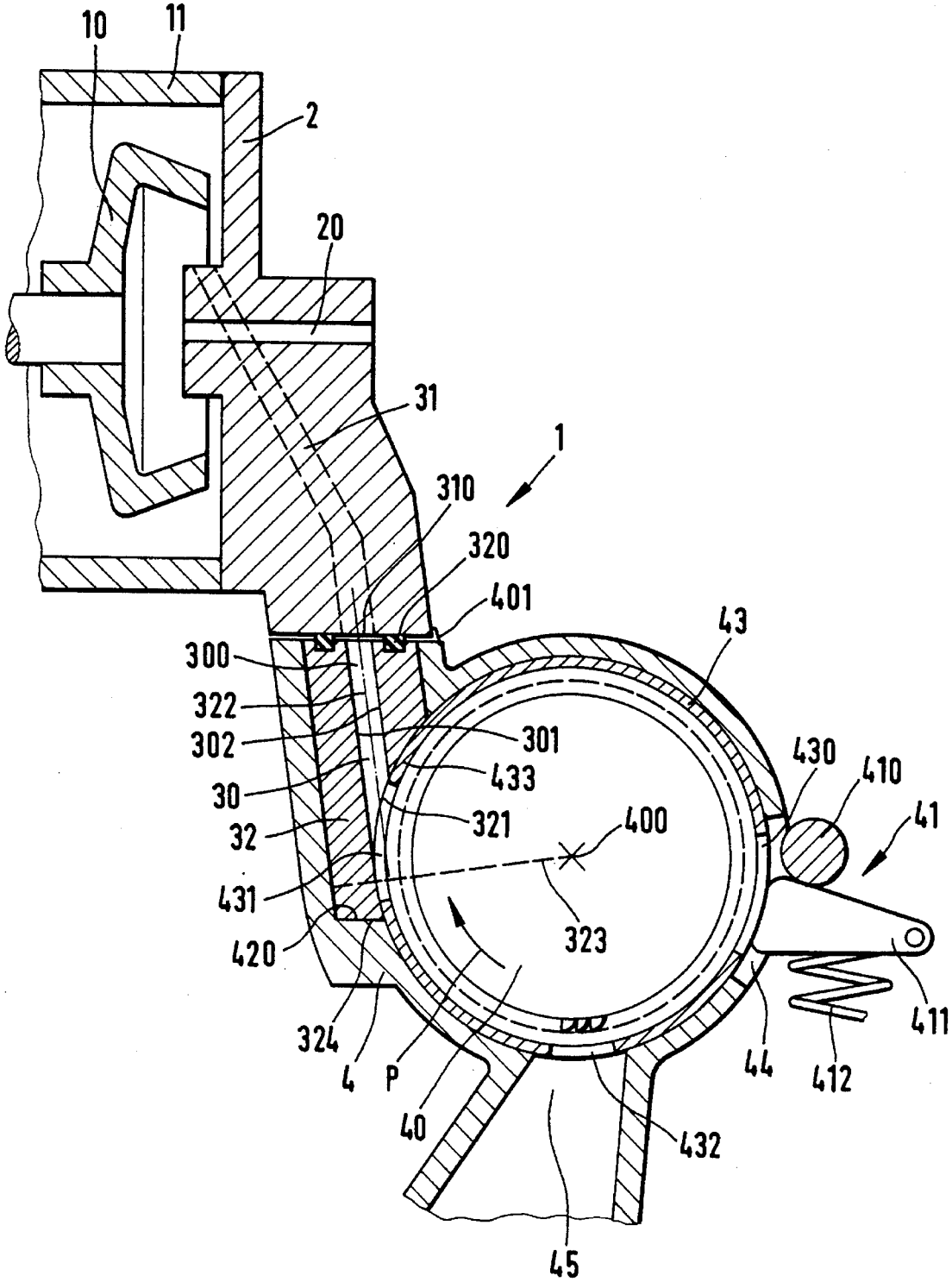
FIG. 1 shows an open-end spinning device designed according to the invention, in a section.

Reference will now be made in detail to the presently preferred embodiments of the invention, one or more examples of which are illustrated in the drawings. Each example is provided by way of explanation of the invention, and not meant as a limitation of the invention. In fact, it should be understood that features illustrated or described as part of one embodiment can be used on another embodiment to yield still a further embodiment.

The invention is explained hereinafter through the example of a spinning device 1 which is provided with a spinning rotor 10 as the spinning element, but it can also be used with other open-end spinning devices, e.g. with friction spinning devices.

The spinning rotor 10 according to FIG. 1 is rotatably installed in a housing 11. The latter can be covered by a cover 2 which is supported by a swivelling cover (not shown) covering the individual elements of the spinning device 1. The cover 2 accepts a yarn draw-off pipe 20 as well as the channel part 31 of a fiber feeding channel.

Another channel part 30 of the fiber feeding channel is located in an insertion piece 32. The insertion piece 32 is located in a housing 4 which contains a driven opener roller 40. The opener roller 40 is preceded by a delivery device 41 equipped in the usual manner with a driven delivery roller 410 with which a feed trough 411 subjected to the force of a compression spring 412 interacts.

In the shown embodiment, the housing 4 is provided in a known manner with dirt collection opening 45 between an opening 44 containing the delivery device 41 and the insertion piece 32.

In one of the two adjacent faces of the two channel parts 30 and 31, a sealing ring 320 is provided in a groove. The inlet opening 310 of the channel part 31 which is essentially coaxial with the channel part 30 in its operating position is furthermore normally larger than the outlet opening 300 of the channel part 30, so that no edges on which fibers may become caught extend into the fiber feeding channel.

The insertion piece 32 has an essentially cylindrical outer contour and is mounted in housing 4 so as to be axially displaceable. For this purpose housing 4 is provided with a cylindrical recess 42 (see FIG. 2) to receive the insertion piece 32.

Housing 4 is provided with an insert 43 in the form of a liner which covers the entire inner circumferential surface of housing 4 and only has technologically necessary openings. These are an opening 430 in the area of the delivery device 41, an opening 431 in the area of the fiber feeding channel and, if a dirt collection opening 45 is provided as in the shown embodiment, an opening 432 to evacuate dirt. The opening 430 makes it possible to feed a fiber sliver (not shown) to the opener roller 40 while the opening 431 allow fibers to exit from the interior of housing 4 into the fiber feeding channel consisting of channel parts 30 and 31. The opening 431 is sized and placed so that the insert 43 covers the end of the insertion piece 32 towards the opener roller 40 on its upstream side (with reference to arrow P). On the downstream side the insertion piece 32 is also covered. Here the insert 43 protrudes slightly over the inlet opening 310 of the channel part 31, so that a relatively sharp fiber separation edge 433 is formed.

The surface 321 of the insertion piece 32 towards the insert 43 is curved concavely, following the outer circumferential surface of the insert 43. The surface 321 extends here up to the side which, relative to the perpendicular 323 dropped from the center 400 of the opener roller 40 onto the longitudinal axis 322 of the insertion piece 32, is turned away from the channel part 31.

In the embodiment shown in FIG. 1, the insert 43 is made of an elastic material and is made, e.g., in the form of a closed ring or of a circumferential surface of a pot-shaped element. Due to this elasticity of the insert 43, a certain resistance must first be overcome as the insertion piece 32 is introduced into the recess 42, said resistance being due to the fact that the end of the insertion piece 32 away from the sealing ring 420 must deform insert 43 slightly in the direction of center 400 in order to overcome the narrowest point of the recess 42 near the perpendicular 323. When the end of insertion piece 32 away from sealing ring 320 has passed this point, the area with a smaller cross-section comes into the area of perpendicular 323. Insert 43 is again able to distend and in this process presses insertion piece 32 into its operating position in which the narrowest point of the insertion piece 32 is located in the area of perpendicular 323. The insert 32 is then fixed in this position.

The length of insertion piece 32 is determined so that in this operating position of the insertion piece 32 at least the sealing ring 320 of the insertion piece 32 protrudes over the face (surface 401) of the sleeve-like portion of housing 4 which contains the insertion piece 32, so that in its operating position the cover 2 may be able to bring the channel parts 30 and 31 into tight contact with each other.

For spinning, the fiber sliver is presented to the delivery device 41 which conveys the fiber sliver to the opener roller 40. The opener roller 40 rotating in the direction of arrow P combs fibers from the leading end of the fiber sliver. These fibers enter the fiber feeding channel 30, 31 and go from there into the spinning rotor 10 where they are deposited in a fiber collection groove and form a fiber ring therein. The end of a yarn which is continuously withdrawn by a not-shown draw-off device is in contact with the fiber ring and thereby incorporates the fiber ring into its end for the continuous formation of the yarn.

The transitions from one element to the other are especially critical for fiber orientation and for the conveying of the fibers to the spinning element (spinning rotor 10). At these points, special care must be taken in the relative placement of the elements adjoining each other.

Following the opening of the fiber sliver fed to the opener roller 40, the first such critical location is the passage from the inner wall of the housing 4 which contains the opener roller 40 to the first channel part 30 of the fiber feeding channel. This passage must be configured so that no fibers may become caught and adhered at this point.

This goal is achieved in that the insertion piece 32 is held axially immobile in the housing 4, whereby the insert 43 extends beyond the channel part 30 in the area of its inlet, so that no fibers can adhere between insert 43 and insertion piece 32. This is all the more important as the surface of the insertion piece 32 towards the lining 43 is adapted in its form to the circumference of the insert 43 turned towards the insertion piece.

The cover 2 containing the channel part 31 has a movement component parallel to the longitudinal axis 322 of the insertion piece 32 in its movement from a not-shown rest position in which it uncovers the shown face of housing 11 into the operating position shown in FIG. 1 in which it presses sealingly against housing 11, whereby the elasticity of the sealing ring 320 has different tolerances in such a manner that a tight seal of the fiber feeding channel between the channel parts 30 and 31 is always ensured in the operating position of cover 2. In addition, the inlet cross-section of the channel part 31 which is placed flush with the first channel part 30 is greater than the outlet cross-section of the first channel part 30, so that catching and accumulation of fibers is also reliably avoided at this critical location.

Due to the above-described construction of the device, the insertion piece 32 with the first channel part 30 can be replaced easily by another insertion piece 32 if necessary. Such a replacement of the insertion piece 32 may become necessary due to wear of the channel part 30 for example. Such a replacement may however also be of advantage when changing the material to be spun.

If a replacement of the insertion piece is to be carried out, this is possible after releasing the face of the insertion piece 32 towards the cover 2 by opening the cover 2 and by pulling out the insertion piece 32 axially from the housing 4. Here a resistance which at first increases must again be overcome until the end of the insertion piece 32 away from the sealing ring 320 has passed the location of the perpendicular 323.

In the interest of simple and rapid removal of the insertion piece 32, it is advantageous if the latter protrudes from the recess 42 of housing 4. If, however, no insert 43 is provided for the housing 4, so that the end of the insertion piece 32 towards the housing 4 is accessible, it is absolutely sufficient if the insertion piece 32 is essentially in flush alignment with housing 4, insofar as tight sealing contact between the cover 2 and the channel part 31 at the sealing ring 320 is then still ensured. An embodiment of an opener roller housing (housing 4) where the insert 43 may be omitted shall be discussed later in connection with FIG. 6.

Figure 4:
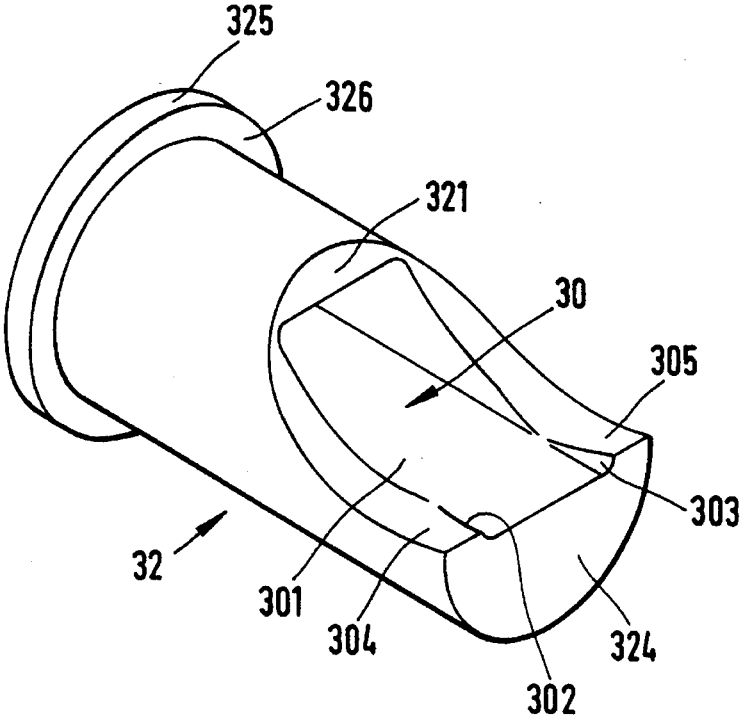
FIG. 4 shows a perspective view of an insertion piece for the opening roller housing made according to the invention.

In the embodiment shown in FIG. 1, the first wall 301 of the channel part 30 placed in the direction of arrow P starts essentially in proximity of perpendicular 323 and then merges at that location into a concave surface 321 which is adapted to the convexly curved outer surface of the insert 43. Since the insert 43 is however covering the end of insertion piece 32 located in housing 4, it is also possible according to FIGS. 4 and 2 to alternatively provide for the first wall 301 of the channel part 30 to be extended to the end of the insertion piece 32 and to be delimited in the extended area, i.e. relative to the perpendicular 323 dropped on the longitudinal axis 322 of the insertion piece 32 on the side away from the spinning element, e.g. the spinning rotor 10, laterally by two lateral walls 302 and 303 whose edges 304 or 305 towards the insert 43 are adapted to the curvature of the lining in form of insert 43 of housing 4. The described catch effect to fix the insertion piece 32 in its operating position is in that case achieved by the lateral walls 302 and 303 with their edges 304 and 305 in interaction with the circumference of the elastic insert 43.

In the described embodiment, the ring or pot-shaped insert 43 constitutes a catch together with the insertion piece 32. As a result of their curvature and the fact that the insertion piece 32 extends in relation to the perpendicular 323 dropped on the longitudinal axis 322 of the insertion piece 32 from the side towards the spinning element up to the side away from the spinning element, e.g. spinning rotor 10. The insert 43 exerts pressure on the insertion piece 32 when the latter has passed the foot of perpendicular 323 with its thicker end away from the spinning element as it is introduced into the recess 42 of housing 4. Based on this force component, the insertion piece 32 is then brought into its operating position where it is then held as a result of the catch effect of the described device. In this process the insert 43 acts as a stop for the insertion piece 32 and delimits its insertion movement in that the insertion piece 32 comes to lie against the outer surface of insert 43 with its surface 321 which is adapted to the curvature of insert 43. In particular, the part of surface 321 which is located after the longitudinal axis 322 (central axis) of the insertion piece 32 relative to the direction of rotation (arrow P) serves here as a stop interacting with the insert 43.

The stop of housing 4 which interacts with the insertion piece 32 is constituted in the above-described embodiment by the outer circumferential wall of the insert 43. If the surface 321 of the insertion piece 32 towards insert 43 constitutes a stop interacting with the outer surface of insert 43, this is especially advantageous because it is easiest in this manner to avoid slits between these parts and thereby the catching of fibers at this location. However, the invention is not limited to such stops.

Figure 6:
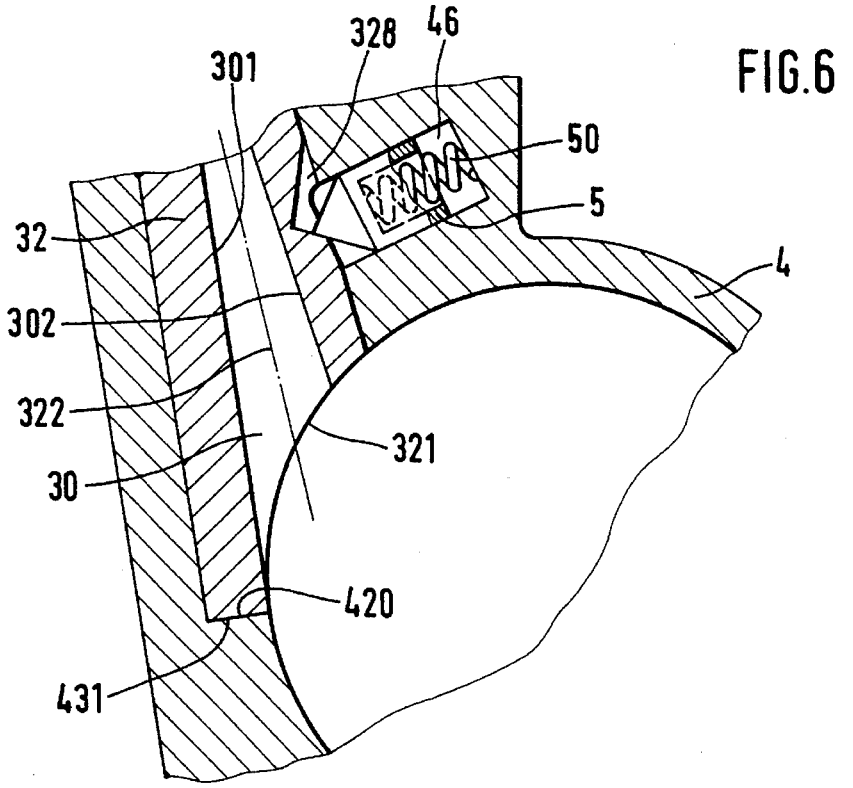
FIG. 6 shows an embodiment of the object of the invention in form of a catch, in a section.

As shown in FIG. 6, it is also possible to provide for the face 420 of recess 42 to constitute this recess which then interacts with the faces 324 (FIG. 1) of the insertion piece 32.

As the above description already shows, the described device can be subjected to a number of modifications within the framework of the instant invention, e.g. by replacing certain characteristics by equivalents or by using them in other combinations. Thus, it is not required for the stop which limits the movement of the insertion piece 32 in the direction of housing 4 to be constituted by its surface 321 adapted to its ring or pot shaped insert 43 or by the surface 321 away from the face 324 (see FIG. 4). Instead it is possible to provide alternatively for the insertion piece 32 to protrude from the housing 4 and for being provided in this area protruding from housing 4 with a collar 325. Collar 325 has a surface 326 on its side towards housing 4 which is made as a stop and interacts with a surface 401 of housing 4 constituting a counter-stop (see FIGS. 2 and 3).

Figure 2:
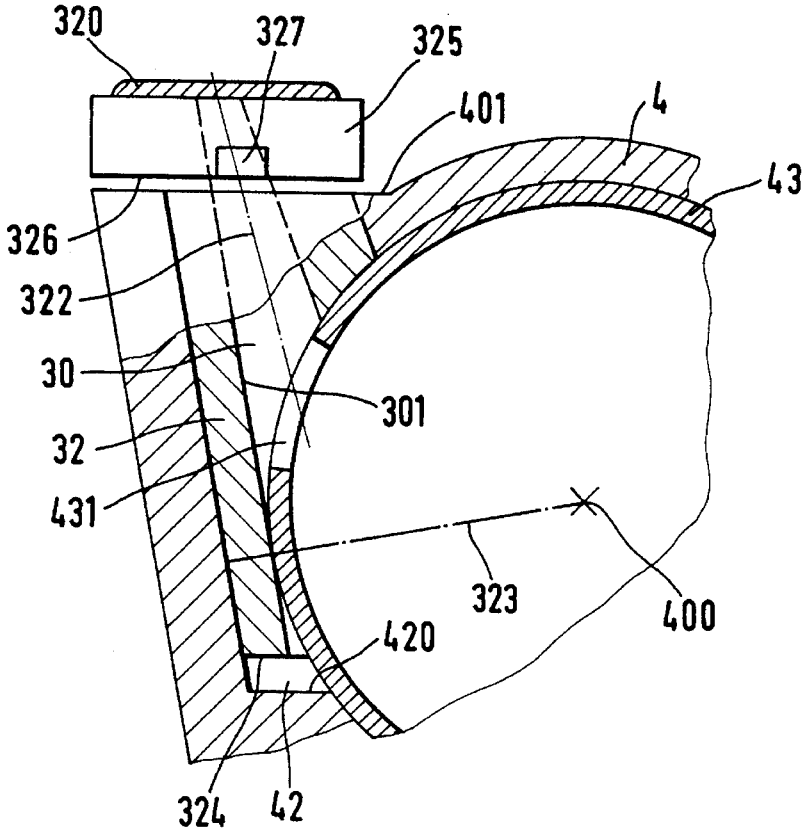
FIG. 2 shows a detail of the device shown in FIG. 1, in a modified design.

The collar 325 shown in FIG. 2 can constitute a stop in the above-described manner with its surface 326 towards the housing 4, interacting with a counter-stop which is constituted by the surface 401 of housing 4 towards collar 325. Whether collar 325 is made in the form of a stop or not however, it facilitates in any case the handling of the insertion piece 32, in particular as it is being removed. If the distance between the surfaces 326 and 401 is sufficiently great, the collar 325 of the insertion piece 32 can be held from behind, and this makes for considerably easier removal of the insertion piece 32.

When the surfaces 326 and 401 interact as stops, the introduction of a tool into the slit between the two surfaces 326 and 401 facing each other can also be facilitated in that at least one of these two surfaces being distanced from the other by a radius or a bevel so that the slit is enlarged in this area. Alternatively, it is possible for one of these two surfaces 326 or 401 (surface 326 in FIGS. 2 and 3) to be provided with a recess 327 which extends radially outward relative to this surface and is of such size that a tool can be introduced temporarily into this recess 327. This temporary introduction of a suitable lift-out tool, consisting for example of the blade of a screwdriver, makes it especially easy to lift the insertion piece 32 against the effect of insert 43 (which seeks to push the insertion piece 32 into housing 4 and to hold it there with a force component) to such an extent out of housing 4 that the insertion piece 32 leaves the catch position, i.e. passes the footing of perpendicular 323 with its end away from collar 325.

Figure 3:
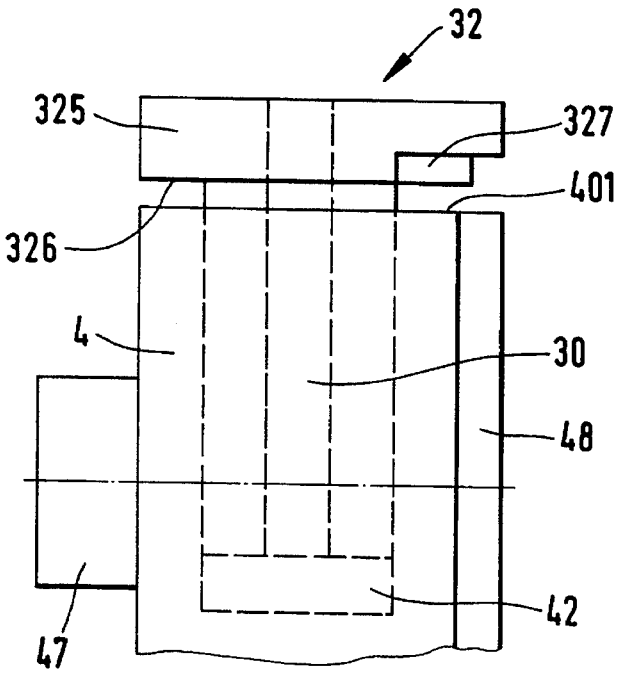
FIG. 3 shows a front view of the device shown in FIG. 2.

As shown in FIG. 3, housing 4 in which the opener roller 40 is located and which contains the insertion piece 32, is provided on its forward side in the usual manner with a space-consuming bearing 47 to support the opener roller 40 which can be made accessible by a thin removable cover 48 located on the other side of housing 4. In practice more space is available on the cover side of the housing 4 than on the bearing side of housing 4 since it must be possible to remove the cover 48 and to render the opener roller 40 accessible. For this reason the recess 327 in FIG. 3 (which, as shown, may be located optionally in the surface 326 of collar 325 of insertion piece 32 or in the surface 401 of housing 4 towards the collar 325) is provided on the cover side of housing 4 and thereby on the side of housing 4 which is away from bearing 47 of the opener roller 40.

The catch described through FIGS. 1 and 2 which is constituted by the elastic insert 43 is a special configuration of an elastic retaining element. Another design, in which the retaining element is also made in the form of a catch, is shown in FIG. 6. Such a catch - at variance with the drawing of FIG. 6 - may also be used in combination with a ring or pot-shaped elastic or rigid lining (insert 43 - see FIG. 5).

In the same manner as with the device described through FIGS. 1 and 2, the retaining element is here placed on the side of insertion piece 32 located on the second wall 302 of the channel part 30 - relative to the direction of rotation (arrow P) of the opener roller 40 (not shown). In this manner, it exerts a pressure upon the insertion piece 32 in the direction of its longest wall. This is of special advantage because the insertion piece then has especially good guidance in its operating position, but some other arrangement of the retaining element is also possible, depending on the design of the device.

The retaining element shown in FIG. 6 consists of a catch element 5 which is mounted in a recess 46 of housing 4. The recess 46 extends essentially at a right angle to the longitudinal axis 322 of the insertion piece 32 and in addition to the catch element also accepts a compression spring 50 which bears upon the bottom of the recess 46 and pushes the catch element 5 the direction of the insertion piece 32.

Different forms are possible for the catch element 5. For example, it may be made in the form of a ball. According to FIG. 5 the catch element has the form of a hollow cylinder with a conical point at its end towards the insertion piece 32. Means not shown here and normally used for such purposes prevent the catch element 5 from coming completely out of the recess 46

A notch-like recess 328 in which the catch element 5 can catch is provided in the circumference of the insertion piece 32 to interact with the catch element 5. Here the recess 328 of FIG. 6 is placed so that the catch element 5 caught in the recess 328 exerts a pressure upon the insertion piece 32 in the direction of the forward face 420 of the recess 42. The forward face 420 interacts as a stop with the forward face 324 of the insertion piece 32 which also constitutes a stop and in this manner limits the axial movement of the insertion piece 32 and thus determines the operating position of the insertion piece 32.

The catch element 5 and the recess 46 are designed so that the insertion piece 32 pushes the catch element 5 more deeply into recess 46 in its axial movement into the operating position or out of same while overcoming the resistance of the compression spring 50, until the catch element 5 leaves the recess 328. Installation or removal of the insertion piece 32 is thus easily carried out, even if the insertion piece 32 should not be accessible from the outside of the housing.

While the retaining element (insertion 43 or catch element 5) is part of a catch in the above-described embodiment of the device, a further variant of the device, in which the retaining element is part of a clamping device, shall now be described through FIG.5.

Similarly, as in the embodiment previously described through FIG. 6, a recess 460 is provided here too in the housing 4. Recess 460 contains a clamping element 51 as well as a compression spring 50 which bears upon the front of the recess 460 and pushes the clamping element 51 in the direction of the insertion piece 32. The surface of the clamping element 51 towards the insertion piece 32 is here adapted to the outer contour of the insertion piece 32.

The clamping element 51 holds the insertion piece 32 in its operating position which is determined by the interacting surfaces 324 and 420 of the insertion piece 32 and of the recess 42 of housing 4 which are made in form of stops. The position of the clamping element 51 in which the latter protrudes most from the recess 460 can be determined here too in the manner normally used for such purposes. In order to enable the edge delimiting the surface 321 on its side towards the clamping element to pass the clamping element 51, the clamping element 51 may be provided with suitably beveled edges. In addition or alternatively, the clamping element 51 may be controllable, i.e. it may be possible to move it from its clamping position into a release position in which the clamping element 51 is completely withdrawn into the recess 460, so that the insertion piece 32 may be moved axially without impediment in order to be installed or removed. For example, a threaded bolt (not shown) may be provided coaxially with the compression spring 50, said bolt being rotatably connected to the clamping element 51 and protruding through a threaded bore (not shown) up to the outside of the housing 4 where it is provided with a drive surface (multiple corners, wing, etc.) by means of which it can be twisted thereby moving the clamping element 51 axially. In another embodiment of such a clamping device which is also not shown, the clamping element 51 may be connected by means of a coaxial bolt to a swivel arm articulately connected on the outside to the housing 4 so that it may be moved into or out of its braked position by swivelling this swivel arm. In this case the swivel arm may also be provided with a catch which fixes the swivel arm in the desired position.

Figure 5:
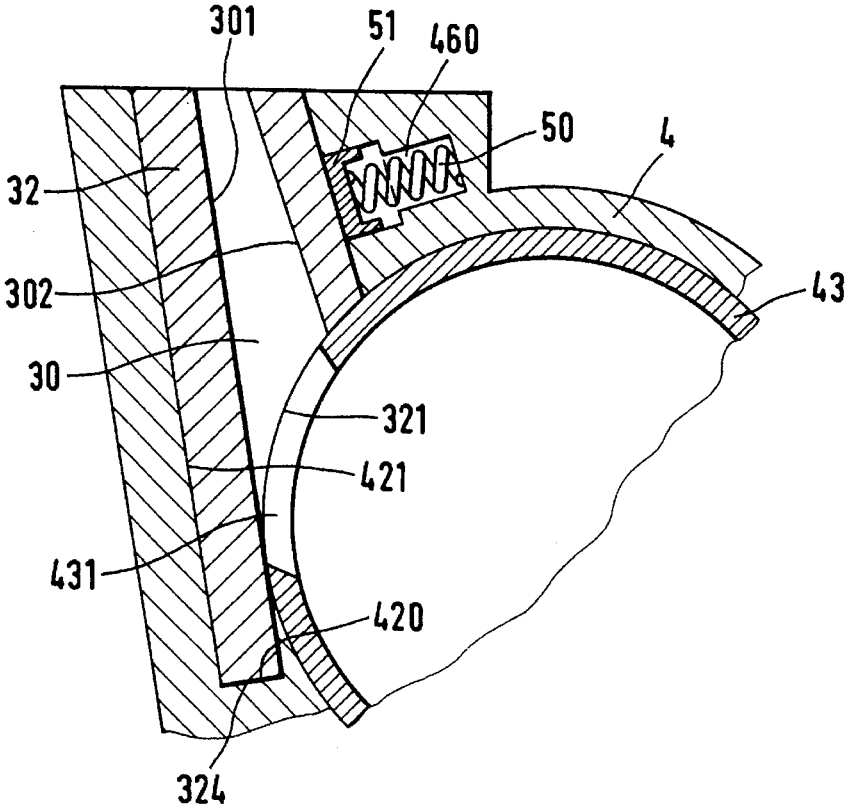
FIG. 5 shows an embodiment of the invention in the form of a clamping device, in a section.

FIG. 5 shows a ring or pot-shaped insert 43. The insert 43 has here such thick walls, or is made of such a material that it is no longer elastic. In such case the device shown in FIG. 5 can nevertheless be made in the form of a catch or clamping device in that the recess 43 is provided with an elastic element on the side of insertion piece 32 away from the rigid insert 43, pushing the insertion piece 43 against the insert 43, but able to yield elastically and move out of the way when the end of insertion piece 32 with a widened cross-section passes the narrow point between the recess wall and the insert 43.

As FIG. 5 furthermore shows, it is also possible, if the insert 43 is elastic or if the insertion piece 32 is placed elastically in housing 4, to omit the clamping device with the clamping element 51 and to make the insert 43 itself as a clamping device. In that case the portion of the insertion piece 32 which extends furthest from the spinning element is clamped between the wall 421 of recess 42 away from the insert 43 and the liner 43.

When the surfaces 324 and 420 interact as stops, the insert can be omitted in the embodiment shown in FIG. 5 (see also FIG. 6). Especially when the surface 321 of the insertion piece 32 extends somewhat further into the center 400 (as seen in the direction of arrow P) than the inner wall 402 of housing 4 which follows surface 321 (see FIG. 6), there is no danger that fibers get caught here, even if a slit were to form here as a result of not very tight tolerances.

Although it is possible to provide interacting pairs of stops at several points of the insertion piece 32 and of housing 4, it goes without saying that providing two or more such pairs of stops should be avoided, since otherwise very narrow manufacturing tolerances would have to be observed in order to avoid static redundancies, and this would also make replacement of the insertion piece 32 more difficult.

Whether an insert 43 is provided for housing 4 or not, the surface 321 of insertion piece 32 towards the opener roller 40 should be adapted to the form of the interior of housing 4 which contains the opener roller 40. For this purpose provisions are made so that the insertion piece 32 is in its operating position as the final machining of this surface 321 is carried out and is machined together with the inner wall 402 of housing 4. It must be ensured here that the insertion piece 32 does not leave its position which it will assume later during operation as it is being machined. This is achieved by means of a design according to FIG. 7.

This figure shows the area of housing 4 surrounding the insertion piece 32 in a top view. The insertion piece 32 presses here with its collar 325 (see also FIG. 2) against the surface 401 of housing 4 when it is in its operating position. The collar 325 has a non-round cross-section at least over part of its circumference so that collar 325 may be able to interact with a guide 49 attached to the housing 4 and be prevented thereby from rotating.

Figure 7:
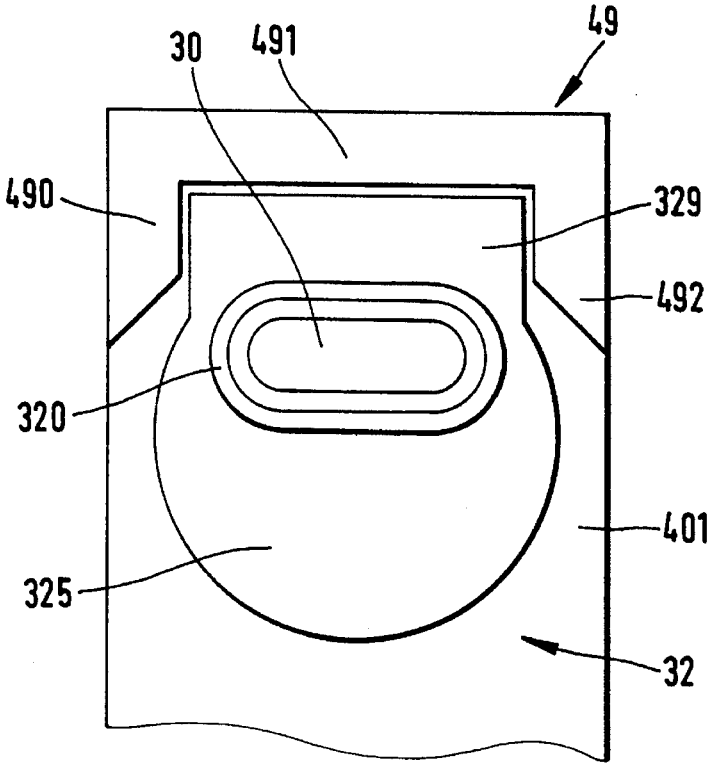
FIG. 7 shows a top view of the opening roller housing and of the inserted insertion piece.

According to FIG. 7, the surface 401 of housing 4 is surround by three sides of guide ridges 490, 491 and 492 forming a rectangle which together constitute guide 49. Accordingly, the collar 325 has a rectangular outer contour in the form of an extension 329 which secures the position of the insertion piece 32 when the latter is in its operating position since extension 329 is prevented by guide 49 from rotating.

In order to prevent rotation of the insertion piece 32 during machining and later during operation, bilateral guidance of the collar 325 by means of the guiding ridges 490 and 492 is sufficient. In order to serve as lateral guide for the cover 2 while the latter is being swivelled towards the spinning element (spinning rotor 10) so that the second channel part 31 is in alignment with the first channel part 30, the guidance ridges 490 and 492 are of such height that they extend above the collar 325 of the insertion piece 32 in its operating position.

As FIG. 7 shows, an additional guiding ridge 491 connecting the guiding ridges 490 and 492 to each other is provided (in the preferred embodiment). It serves as a stop for the cover 2 and thereby also for the second channel part 31 which thus assumes a defined position relative to the first channel part 30.

When the insertion piece 32 is held in its rotational position on the one hand via its collar 325 by the guide 49 and on the other hand by insert 43, this leads to more or less important tensions because of the static redundancy, with the consequence of creating gaps that are more or less wide between the parts guiding the fibers (insert 43 on the one hand and insertion piece 32 on the other hand). The additional consequence of this is an increased catching of fibers which thus accumulate into a fiber clot which may come loose at unforeseen points in time to be fed to the spinning element for spinning. This leads to thick spots or breakage in the yarn. In order to avoid these, the guide 49 of collar 325, i.e. its extension 329, is surrounded with a certain clearance, even if relatively minimal, but sufficient to prevent jamming of the insertion piece 32 and a resulting gap, so that the danger of fibers being caught is eliminated in advance.

Also if the insertion piece 32 is to be machined in its operating position, the described guide 49 is not absolutely necessary. If the guide of cover 2 is not required or not desirable, guidance of the insertion piece 32 can also be achieved in that the insertion piece 32 and the recess 42 are given non-round cross-sections coordinated with each other.

It should be apparent to those skilled in the art that various modifications and variations can be made in the present invention without departing from the scope and spirit of the invention. For example, features illustrated or described as part of one embodiment can be used with another embodiment to yield a still further embodiment. It is intended that the present invention cover such modifications and variations as come within the scope of the appended claims and their equivalents.

We claim:

1. An open-end spinning device, comprising:

a spinning element an opener roller housed in an interior of a housing;

a fiber feeding channel extending from said housing to said spinning element, said fiber feeding channel comprising a first channel part and a second channel part which is movable relative to said first channel part so as to be alignable therewith, said first channel part comprising an insertion piece removably disposed within a recess defined in said housing; and an elastic retaining element disposed in said housing and configured to apply an elastic force to said insertion piece biasing said insertion piece towards said opener roller in an operating position within said recess.

2. The device as in claim 1, wherein said elastic retaining element exerts said elastic force in a radial direction against said insertion piece with respect to said opener roller.

3. The device as in claim 1, wherein said insertion piece and said housing comprise mating stops which delimit movement of said insertion piece within said recess.

4. The device as in claim 3, wherein said elastic retaining element comprises a circumferential insert which lines at least a portion of said interior of said housing around said opener roller, said housing stop comprising a portion of a circumferential wall of said insert, said insertion piece stop comprising a form matching said portion of said circumferential wall of said insert.

5. The device as in claim 1, wherein said elastic retaining element comprises an insert which lines at least a portion of said interior of said housing around said opener roller.

6. The device as in claim 1, further comprising a clamping element for retaining said insertion piece within said recess, said elastic retaining element being a component of said clamping element.

7. The device as in claim 6, wherein said clamping element comprises an elastic ring shaped insert disposed within said housing interior and a cooperating inner wall of said recess, said insertion piece slidable between a portion of said ring shaped insert and said cooperating inner wall.

8. The device in claim 1, wherein said elastic retaining element comprises a catch for retaining said insertion piece within said recess.

9. The device as in claim 8, wherein said catch acts upon said insertion piece with an elastic force in the direction of a stop defined within said housing against which said insertion piece contacts.

10. The device as in claim 1, wherein said elastic retaining element comprises a circumferential insert which lines at least a portion of said interior of said housing around said opener roller, said first channel part comprising lateral walls defining a portion of said fiber feeding channel with a curvature matching that of said circumferential insert, whereby with respect to a perpendicular line from the center of said opener roller to a longitudinal axis of said first channel part, a portion of said later walls extend in said recess past said perpendicular line.

11. The device as in claim 1, wherein said insertion piece extends outward beyond said housing and includes a collar in the area of said outward extending portion.

12. The device as in claim 11, wherein said collar comprises a recess defined therein for acceptance of removal tool for pulling said insertion piece from said housing.

13. The device as in claim 12, further comprising a bearing for said opener roller, said housing comprising a face supporting said bearing, said recess defined in said collar on a side of said housing opposite said bearing.

14. The device as in claim 11, wherein said housing further comprises a guide disposed on a side thereof facing said spinning element, said guide surrounding at least a portion of said collar and acting as an anti-rotation device for preventing rotation of said insertion piece within said recess.

15. The device as in claim 14, further comprising a clearance space between an outer contour of said collar and the portion of said guide surrounding said collar.

16. The device as in claim 11, wherein said guide extends outward beyond said collar and acts as an alignment mechanism for said movable second channel part.

* * * * *